US005816162A

United States Patent [19]

Vermeersch

[11] Patent Number: 5,816,162

[45] Date of Patent: Oct. 6, 1998

[54] METHOD FOR MAKING A LITHOGRAPHIC PRINTING PLATE BY IMAGE-WISE HEATING AN IMAGING ELEMENT USING A THERMAL HEAD

[75] Inventor: Joan Vermeersch, Deinze, Belgium

[73] Assignee: Agfa-Gevaert, N.V., Mortsel, Belgium

[21] Appl. No.: 747,667

[22] Filed: Nov. 12, 1996

Related U.S. Application Data

[60] Provisional application No. 60/011,002, Feb. 1, 1996.

[30] Foreign Application Priority Data

Nov. 16, 1995 [EP] European Pat. Off. ..... 95203129

[51] Int. Cl.[6] ..... B41C 1/10; B41M 5/36

[52] U.S. Cl. ..... 101/467; 101/462

[58] Field of Search ..... 101/453, 454, 101/456, 457, 460, 462, 467, 450.1, 451

[56] References Cited

U.S. PATENT DOCUMENTS

| | | | |
|---|---|---|---|
| 3,476,937 | 11/1969 | Vrancken | 101/470 |
| 4,004,924 | 1/1977 | Vrancken et al. | 101/470 |
| 4,258,122 | 3/1981 | Uchida et al. | 101/456 |
| 5,409,799 | 4/1995 | Uytterhoeven et al. | 101/467 |
| 5,569,573 | 10/1996 | Takahashi et al. | 101/453 |
| 5,607,816 | 3/1997 | Fitzgerald et al. | 101/451 |

OTHER PUBLICATIONS

Research Disclosure, Jan. 1992, 33303, "A Lithographic Printing Plate", J. Vermeersch.

*Primary Examiner*—Stephen R. Funk
*Attorney, Agent, or Firm*—Breiner & Breiner

[57] ABSTRACT

The present invention provides a method for making a lithographic printing plate wherein an imaging element is image-wise heated by means of a thermal head. The imaging element comprises on a flexible support (i) an ink-repellant layer containing a cross-linked hydrophilic binder and (ii) an image forming layer comprising hydrophobic thermoplastic polymer particles dispersed in a hydrophilic binder. Subsequent to image-wise heating, the imaging element is developed with water or an aqueous liquid. Development may also be carried out on-press. Moreover, image-wise heating and development can both be carried out on press.

11 Claims, No Drawings

METHOD FOR MAKING A LITHOGRAPHIC PRINTING PLATE BY IMAGE-WISE HEATING AN IMAGING ELEMENT USING A THERMAL HEAD

This application claims priority from provisional application Ser. No. 60/011,002, filed on Feb. 1, 1996.

FIELD OF THE INVENTION

The present invention relates to a method for making a lithographic printing plate involving image-wise heating of an imaging element by means of a thermal head.

BACKGROUND OF THE INVENTION

Lithography is the process of printing from specially prepared surfaces, some areas of which are capable of accepting lithographic ink, whereas other areas, when moistened with water, will not accept the ink. The areas which accept ink form the printing image areas and the ink-rejecting areas form the background areas.

In the art of photolithography, a photographic material is made imagewise receptive to oily or greasy inks in the photo-exposed (negative-working) or in the non-exposed areas (positive-working) on a hydrophilic background.

In the production of common lithographic printing plates, also called surface litho plates or planographic printing plates, a support that has affinity to water or obtains such affinity by chemical treatment is coated with a thin layer of a photosensitive composition. Coatings for that purpose include light-sensitive polymer layers containing diazo compounds, dichromate-sensitized hydrophilic colloids and a large variety of synthetic photopolymers. Particularly diazo-sensitized systems are widely used.

Upon image-wise exposure of the light-sensitive layer the exposed image areas become insoluble and the unexposed areas remain soluble. The plate is then developed with a suitable liquid to remove the diazonium salt or diazo resin in the unexposed areas.

Commercially available diazo based printing plates most commonly use an anodized and roughened aluminum as a support having a hydrophilic surface. However, commercial plates are also available that use a flexible support such as paper provided with a hydrophilic layer. For example, Lithocraft 10008 FOTOPLATE™ is a diazo based printing plate that comprises on a paper support a hydrophilic layer on top of which is provided a diazo based photosensitive layer. According to plate instructions of the supplier, a plate can be prepared by image-wise exposure of the lithographic printing plate precursor or imaging element, mounting the exposed imaging element on the press and wiping its surface with LITHOCRAFT® 10008 Developer Desensitizer. The plate instructions also contemplate a method wherein no developer desensitizer is used. However, such method most often results in poor lithographic performance so that in practice a Developer Desensitizer is almost always needed.

A particular disadvantage of photosensitive imaging elements such as described above for making a printing plate is that they have to be shielded from the light. This is a particular disadvantage if on press development is contemplated since mounting the image-wise exposed imaging element is generally done in normal daylight so that the handling time for mounting the imaging element is limited. Moreover, diazo based aluminium type printing plates are completely unsuitable for on press development.

On the other hand, methods are known for making printing plates involving the use of imaging elements that are heat sensitive rather than photosensitive. For example, Research Disclosure no. 33303 of January 1992 discloses a heat sensitive imaging element comprising on a support a cross-linked hydrophilic layer containing hydrophobic thermoplastic polymer particles and an infrared absorbing pigment such as e.g. carbon black. By image-wise exposure to an Infrared laser, the hydrophobic thermoplastic polymer particles are image-wise coagulated thereby rendering the surface of the imaging element and these areas ink acceptant without any further development. A disadvantage of this method is that the printing plate obtained is easily damaged since the non-printing areas may become ink accepting when some pressure is applied thereto. Moreover, under critical conditions, the lithographic performance of such a printing plate may be poor and accordingly such printing plate has little lithographic printing latitude.

SUMMARY OF THE INVENTION

It is an object of the present invention to provide a method for making a printing plate having excellent printing properties in a convenient and environmental friendly way.

Further objects of the present invention will become clear from the description hereinafter.

According to one aspect, the present invention relates to a method for making a lithographic printing plate comprising the steps of:

(1) image-wise heating by means of a thermal head an imaging element comprising on a flexible support (i) an ink-repellant layer containing a cross-linked hydrophilic binder and (ii) an image forming layer comprising hydrophobic thermoplastic polymer particles dispersed in a hydrophilic binder;

(2) developing a thus obtained image-wise heated imaging element with water or an aqueous liquid.

The present invention further provides a method for making a lithographic printing plate comprising the steps of:

(1) image-wise heating by means of a thermal head an imaging element comprising on a flexible support (i) an ink-repellant layer containing a cross-linked hydrophilic binder and (ii) an image forming layer comprising hydrophobic thermoplastic polymer particles dispersed in a hydrophilic binder;

(2) and developing a thus obtained image-wise heated imaging element by mounting it on a print cylinder of a printing press and supplying an aqueous dampening liquid and/or ink to said image forming layer while rotating said print cylinder.

The present invention also discloses a method for making a lithographic printing plate comprising the steps of:

(1) mounting an imaging element comprising on a flexible support (i) an ink-repellant layer containing a cross-linked hydrophilic binder and (ii) an image forming layer comprising hydrophobic thermoplastic polymer particles dispersed in a hydrophilic binder on a print cylinder of a printing press;

(2) image-wise heating said imaging element by means of a thermal head;

(3) and developing a thus obtained image-wise heated imaging element by supplying an aqueous dampening liquid and/or ink to said image forming layer while rotating said print cylinder.

According to a further aspect of the present invention, there is disclosed a method for making multiple copies of an original comprising the steps of:

(1) image-wise heating by means of a thermal head an imaging element comprising on a flexible support (i) an ink-repellant layer containing a cross-linked hydrophilic binder and (ii) an image forming layer comprising hydrophobic thermoplastic polymer particles dispersed in a hydrophilic binder;

(2) mounting a thus obtained image-wise heated imaging element without development, on a print cylinder of a printing press;

(3) rotating said print cylinder while supplying an aqueous dampening liquid and/or supplying ink to said image forming layer of said imaging element and (4) transferring ink from said imaging element to a receiving element.

The present invention also provides a method for making multiple copies of an original comprising the steps of:

(1) mounting an imaging element comprising on a flexible support (i) an ink-repellant layer containing a cross-linked hydrophilic binder and (ii) an image forming layer comprising hydrophobic thermoplastic polymer particles dispersed in a hydrophilic binder on a print cylinder of a printing press;

(2) image-wise heating said imaging element by means of a thermal head;

(3) rotating said print cylinder while supplying an aqueous dampening liquid and/or supplying ink to said image forming layer of said imaging element and (4) transferring ink from said imaging element to a receiving element.

DETAILED DESCRIPTION OF THE INVENTION

An imaging element for use in accordance with the present invention comprises on a hydrophilic surface of a lithographic base an image forming layer comprising hydrophobic thermoplastic polymer particles dispersed in a hydrophilic binder. The hydrophilic binder of the image forming layer used in connection with the present invention is preferably not cross-linked or only slightly cross-linked.

According to the present invention, the lithographic base comprises a flexible support, such as e.g. paper or plastic film, provided with an ink-repellant layer comprising a cross-linked hydrophilic binder. A particularly suitable ink-repellant layer may be obtained from a hydrophilic binder cross-linked with a cross-linking agent such as formaldehyde, glyoxal, polyisocyanate or a hydrolysed tetra-alkylorthosilicate. The latter is particularly preferred.

As hydrophilic binder there may be used hydrophilic (co)polymers such as for example, homopolymers and copolymers of vinyl alcohol, acrylamide, methylol acrylamide, methylol methacrylamide, acrylic acid, methacrylic acid, hydroxyethyl acrylate, hydroxyethyl methacrylate or maleic anhydride/vinylmethylether copolymers. The hydrophilicity of the (co)polymer or (co)polymer mixture used is preferably the same as or higher than the hydrophilicity of polyvinyl acetate hydrolyzed to at least an extent of 60 percent by weight, preferably 80 percent by weight.

The amount of crosslinking agent, in particular of tetraalkyl orthosilicate, is preferably at least 0.2 parts by weight per part by weight of hydrophilic binder, preferably between 0.5 and 5 parts by weight, more preferably between 1.0 parts by weight and 3 parts by weight.

An ink-repellant layer in a lithographic base used in accordance with the present embodiment preferably also contains substances that increase the mechanical strength and the porosity of the layer. For this purpose colloidal silica may be used. The colloidal silica employed may be in the form of any commercially available water-dispersion of colloidal silica for example having an average particle size up to 40 nm, e.g. 20 nm. In addition inert particles of larger size than the colloidal silica can be added e.g. silica prepared according to Stöber as described in J. Colloid and Interface Sci., Vol. 26, 1968, pages 62 to 69 or alumina particles or particles having an average diameter of at least 100 nm which are particles of titanium dioxide or other heavy metal oxides. By incorporating these particles the surface of the ink-repellant layer is given a uniform rough texture consisting of microscopic hills and valleys, which serve as storage places for water in background areas.

The thickness of an ink-repellant layer in a lithographic base in accordance with this embodiment may vary in the range of 0.2 to 25 $\mu$m and is preferably 1 to 10 $\mu$m.

Particular examples of suitable ink-repellant layers for use in accordance with the present invention are disclosed in EP-A 601240, GB-P-1419512, FR-P-2300354, U.S. Pat. No. 3,971,660, U.S. Pat. No. 4,284,705 and EP-A 514490.

As flexible support of a lithographic base in connection with the present embodiment it is particularly preferred to use a plastic film e.g. substrated polyethylene terephthalate film, polyethylene naphthalate film, cellulose acetate film, polystyrene film, polycarbonate film etc. . . . The plastic film support may be opaque or transparent.

It is particularly preferred to use a polyester film support to which an adhesion improving layer has been provided. Particularly suitable adhesion improving layers for use in accordance with the present invention comprise a hydrophilic binder and colloidal silica as disclosed in EP-A 619524, EP-A 620502 and EP-A 619525. Preferably, the amount of silica in the adhesion improving layer is 200 mg per $m^2$ and 750 mg per $m^2$. Further, the ratio of silica to hydrophilic binder is preferably more than 1 and the surface area of the colloidal silica is preferably at least 300 $m^2$ per gram, more preferably a surface area of 500 $m^2$ per gram.

In accordance with the present invention, on top of a hydrophilic surface of the lithographic base there is provided an image forming layer. Optionally, there may be provided one or more intermediate layers between the lithographic base and the image forming layer. An image forming layer in connection with the present invention comprises hydrophobic thermoplastic polymer particles dispersed in a hydrophilic binder.

Suitable hydrophilic binders for use in an image forming layer in connection with this invention are for example synthetic homo or copolymers such as a polyvinylalcohol, a poly(meth)acrylic acid, a poly(meth)acrylamide, a polyhydroxyethyl(meth)acrylate, a polyvinylmethylether or natural binders such as gelatin, a polysacharide such as e.g. dextran, pullulan, cellulose, arabic gum, alginic acid.

Hydrophobic thermoplastic polymer particles used in connection with the present invention preferably have a coagulation temperature above 35° C. and more preferably above 50° C. Coagulation may result from softening or melting of the thermoplastic polymer particles under the influence of heat. There is no specific upper limit to the coagulation temperature of the thermoplastic hydrophobic polymer particles, however the temperature should be sufficiently below the decomposition of the polymer particles. Preferably the coagulation temperature is at least 10° C. below the temperature at which the decomposition of the polymer particles occurs. When said polymer particles are subjected to a temperature above coagulation temperature they coagulate to form a hydrophobic agglomerate in the hydrophilic layer so that at these parts the hydrophilic layer becomes insoluble in plain water or an aqueous liquid.

Specific examples of hydrophobic thermoplastic polymer particles for use in connection with the present invention are e.g. polyethylene, polyvinyl chloride, polymethyl (meth) acrylate, polyethyl (meth)acrylate, polyvinylidene chloride, polystyrene polyacrylonitrile, polyvinyl carbazole etc. or copolymers thereof. Most preferably used is polymethyl (meth)acrylate or polystyrene. The weight average molecular weight of the polymers may range from 5,000 to 1,000,000 g/mol.

The hydrophobic particles may have a particle size from 0.01 μm to 50 μm, more preferably between 0.05 μm and 10 μm and most preferably between 0.05 μm and 2 μm.

The polymer particles are present as a dispersion in the aqueous coating liquid of the image forming layer and may be prepared by the methods disclosed in U.S. Pat. No. 3,476,937. Another method especially suitable for preparing an aqueous dispersion of the thermoplastic polymer particles comprises:

dissolving the hydrophobic thermoplastic polymer in an organic water immiscible solvent, dispersing the thus obtained solution in water or in an aqueous medium and removing the organic solvent by evaporation. The amount of hydrophobic thermoplastic polymer particles contained in the image forming layer is preferably more than 30% by weight, more preferably at least 50% by weight and most preferably at least 65% by weight.

According to a particular embodiment in connection with the present invention, the image forming layer may further comprise a diazonium salt, diazo resin or aryldiazosulfonate resin. Such offers the advantage that subsequent to image-wise heating and development the printing properties, in particular the ink uptake by the image-areas, can be improved by applying an overall UV exposure to the developed imaging element. Such practice will however only be practical in case of off-line exposure and development rather than in an on-press development.

Examples of low-molecular weight diazonium salt for use in the present invention include: benzidine tetrazoniumchloride, 3,3'-dimethylbenzidine tetrazoniumchloride, 3,3'-dimethoxybenzidine tetrazoniumchloride, 4,4'-diaminodiphenylamine tetrazoniumchloride, 3,3'-diethylbenzidine tetrazoniumsulfate, 4-aminodiphenylamine diazoniumsulfate, 4-aminodiphenylamine diazoniumchloride, 4-piperidino aniline diazoniumsulfate, 4-diethylamino aniline diazoniumsulfate and oligomeric condensation products of diazodiphenylamine and formaldehyde.

Examples of diazo resins useful in the present invention include condensation products of an aromatic diazonium salt as the light-sensitive substance. Such condensation products are known and are described, for example, in German Pat. no. 1214086. They are in general prepared by condensation of a polynuclear aromatic diazonium compound, preferably of substituted or unsubstituted diphenylamine-4-diazonium salts, with active carbonyl compounds, preferably formaldehyde, in a strongly acid medium.

Examples of aryldiazolsulfonate resins are disclosed in EP-A 339393 and EP-A 507008, the teaching of which is incorporated herein by reference.

In accordance with a method of the present invention for obtaining a printing plate, the imaging element is image-wise heated with a thermal head, e.g. in a thermal printer, and subsequently is mounted on a print cylinder of a printing press. According to a preferred embodiment, the printing press is then started and while the print cylinder with the imaging element mounted thereon rotates, the dampener rollers that supply dampening liquid are dropped on the imaging element and subsequent thereto the ink rollers are dropped. Generally, after about 10 revolutions of the print cylinder the first clear and useful prints are obtained.

According to an alternative method, the ink rollers and dampener rollers may be dropped simultaneously or the ink rollers may be dropped first.

Suitable dampening liquids that can be used in connection with the present invention are aqueous liquids generally having an acidic pH and comprising an alcohol such as isopropanol. With regard to dampening liquids useful in the present invention, there is no particular limitation and commercially available dampening liquids, also known as fountain solutions, can be used. It may be advantageous to wipe the image forming layer of an image-wise heated imaging element with e.g. a cotton pad or sponge soaked with water before mounting the imaging element on the press or at least before the printing press starts running. This will remove some non-image areas but will not actually develop the imaging element. However, it has the advantage that possible substantial contamination of the dampening system of the press and ink used is avoided.

According to an alternative method, the imaging element is first mounted on the print cylinder of the printing press and then imagewise heated directly on the press. Subsequent to heating, the imaging element can be developed as described above. This embodiment requires that a thermal head is built-in the printing press and offers the advantage of shorting total processing time between paste-up of the original (e.g. prepared on a computer) and actual printing of copies.

According to a still further method in connection with the present invention, the imaging element may be image-wise heated and subsequently developed with plain water or an aqueous liquid. The invention will now be illustrated by way of the following samples without however the intention to limit the invention thereto. All parts are by weight unless otherwise specified.

EXAMPLE 1

Preparation of a Lithographic Base

To 440 g of a dispersion contg. 21.5% $TiO_2$ (average particle size 0.3 to 0.5 μm) and 2.5% polyvinyl alcohol in deionized water were subsequently added, while stirring, 250 g of a 5% polyvinyl alcohol solution in water, 105 g of a hydrolyzed 22% tetramethylorthosilicate emulsion in water and 12 g of a 10% solution of a wetting agent.

To this mixture was added 193 g of deionized water and the pH was adjusted to pH=4.

The obtained dispersion was coated on a polyethylene-terephthalate film support (coated with a hydrophilic adhesion layer) to a wet coating thickness of 50 g/m$^2$, dried at 30° C. and subsequently hardened by subjecting it to a temperature of 57° C. for 1 week.

To this base was further provided an aqueous solution of (pH=5) of Dormacid (a dextran modified with a diethylaminoethyl group available from Pfeifer & Langen) and a cationic wetting agent to a dry coating thickness of 100 mg Dormacid per m$^2$.

The obtained element was then heated for 1 week at 57° C.

Preparation of the Imaging Element

An imaging element was produced by preparing the following coating composition and coating it to the above described lithographic base in an amount of 35 g/m$^2$ (wet coating amount) and drying it at 30° C.

Preparation of the Coating Composition

To 63 g of a 20% dispersion of polymethylmethacrylate (particle diameter of 40 nm) stabilized with cetyltrimethylammonium bromide in deionized water was subsequently added, while stirring, 120 g of a 5% solution of a 98% hydrolized polyvinylacetate, having a number average molecular weight of 200 000 g/mol (MOWIOL™ 56–98 available from Hoechst), in water and 15 g of a 10% dispersion of Heligen™ blue, a blue dispersion from BASF, and 5% polyvinyl alcohol (MOWIOL™ 56–98) in water. 46 g of a 15% solution of the condensation product of diphenylamine diazonium salt and formaldehyde (NEGALUX™ N18 available from PACS) and 20 g of a 15% solution of the condensation product of methoxydiphenylamine diazonium salt and formaldehyde (DIAZO No. 8 available from Fairmount) in water was then slowly added. Finally 30 g of a 1.6% solution of cationic fluor containing surfactant CFLUORAD™ FC135 available from 3M) in water, and 726 ml of water were added.

Preparation of a printing plate and making of copies of the original.

An imaging element as described above was image-wise heated in a DRYSTAR™ MATRIX™ DI2000 thermal printer (commercially available from Agfa-Gevaert NV) and hereafter the non-heated parts were washed-off manually as follows:

- the heated imaging element was put on a flat solid surface and water was applied thereto;
- while rinsing with plain water, the imaging elements surface was wiped with a soft sponge applying a firm pressure to the imaging elements surface until all non-image parts were removed;
- the imaging elements surface was further rinsed with water and excess water was then removed with a soft paper so as to obtain a dry printing plate.

This printing plate was then mounted on an AB Dick 360™ offsetpress equipped with a VARN™ KOMPAC II dampening system. As ink, VANSON RB2329™ and as a dampening liquid G671™ (Agfa-Gevaert NV) was used. Good prints were obtained during printing without ink uptake in the non-image areas.

EXAMPLE 2

An imaging element was prepared as described in example 1 and image-wise heated as in example 1. Subsequently, the image-wise heated imaging element was mounted on the offset press mentioned in example 1. The same ink and dampening liquid were used as in example 1.

Subsequently water the imaging elements surface was wiped with a soft sponge wetted with water thereby removing some non-heated parts of the imaging element.

Subsequently the printing press was started and dampening liquid was supplied to the imaging elements surface by dropping the dampener rollers of the printing press. After 5 revolutions the ink rollers were dropped as well and after a further 5 revolutions, a good printing quality was obtained without any ink uptake in the non-image areas.

EXAMPLE 3

Preparation of a Coating Composition

To 135 g of a 20% dispersion of polymethylmethacrylate (particle diameter of 40 nm) stabilized with cetyltrimethylammonium bromide in deionized water was subsequently added, while stirring, 60 g of a 5% solution of a 98% hydrolized polyvinylacetate, having a number average molecular weight of 200 000 g/mol (MOWIOL™ 56–98 available from Hoechst) and 805 ml of water.

An imaging element was then prepared as described in example using the above coating composition instead of that in example 1. A printing plate was subsequently prepared using a thus obtained imaging element and this printing plate was then used to print as described in example 1.

5000 good prints were printed without ink uptake in the non-image areas.

EXAMPLE 4

An imaging element was prepared as described in example 3 and image-wise heated as in example 1. Subsequently, the image-wise heated imaging element was mounted on the offset press mentioned in example 1. The same ink and dampening liquid were used as in example 1.

Subsequently water the imaging elements surface was wiped with a soft sponge wetted with water thereby removing some non-heated parts of the imaging element.

Subsequently the printing press was started and dampening liquid was supplied to the imaging elements surface by dropping the dampener rollers of the printing press. After 5 revolutions the ink rollers were dropped as well and after a further 5 revolutions, a good printing quality was obtained without any ink uptake in the non-image areas. 5000 copies of good quality were printed.

I claim:

1. A method for making a lithographic printing plate comprising the steps of:

(1) image-wise heating by means of a thermal head an imaging element comprising on a flexible support (i) an ink-repellant layer containing a cross-linked hydrophilic binder and (ii) an image forming layer comprising hydrophobic thermoplastic polymer particles dispersed in a hydrophilic binder;

(2) developing a thus obtained image-wise heated imaging element with water or an aqueous liquid.

2. A method according to claim 1 wherein said flexible support is a plastic film.

3. A method according to claim 1 wherein said hydrophobic thermoplastic polymer particles have a coagulation temperature of at least 35° C.

4. A method according to claim 3 wherein said hydrophobic hydrophobic thermoplastic polymer particles are selected from the group consisting of polyethylene, polystyrene, polymethyl(meth)acrylate, polyvinylchloride, polyethyl(meth)acrylate, polyvinylidenechloride, polyacrylonitrile and polyvinylcarbazole.

5. A method for making a lithographic printing plate comprising the steps of:

(1) image-wise heating by means of a thermal head an imaging element comprising on a flexible support (i) an ink-repellant layer containing a cross-linked hydrophilic binder and (ii) an image forming layer comprising hydrophobic thermoplastic polymer particles dispersed in a hydrophilic binder;

(2) and developing a thus obtained image-wise heated imaging element by mounting it on a print cylinder of a printing press and supplying an aqueous dampening liquid and/or ink to said image forming layer while rotating said print cylinder.

6. A method for making a lithographic printing plate comprising the steps of:

(1) mounting an imaging element comprising on a flexible support (i) an ink-repellant layer containing a cross-linked hydrophilic binder and (ii) an image forming layer comprising hydrophobic thermoplastic polymer particles dispersed in a hydrophilic binder on a print cylinder of a printing press;

(2) image-wise heating said imaging element by means of a thermal head;

(3) and developing a thus obtained image-wise heated imaging element by supplying an aqueous dampening liquid and/or ink to said image forming layer while rotating said print cylinder.

7. A method for making multiple copies of an original comprising the steps of:

(1) image-wise heating by means of a thermal head an imaging element comprising on a flexible support (i) an ink-repellant layer containing a cross-linked hydrophilic binder and (ii) an image forming layer comprising hydrophobic thermoplastic polymer particles dispersed in a hydrophilic binder;

(2) mounting a thus obtained image-wise heated imaging element without development, on a print cylinder of a printing press;

(3) rotating said print cylinder while supplying an aqueous dampening liquid and/or supplying ink to said image forming layer of said imaging element and (4) transferring ink from said imaging element to a receiving element.

8. A method for making multiple copies of an original comprising the steps of:

(1) mounting an imaging element comprising on a flexible support (i) an ink-repellant layer containing a cross-linked hydrophilic binder and (ii) an image forming layer comprising hydrophobic thermoplastic polymer particles dispersed in a hydrophilic binder on a print cylinder of a printing press;

(2) image-wise heating said imaging element by means of a thermal head;

(3) rotating said print cylinder while supplying an aqueous dampening liquid and/or supplying ink to said image forming layer of said imaging element and (4) transferring ink from said imaging element to a receiving element.

9. A method according to any of the above claims wherein said hydrophilic binder in said image forming layer is selected from the group consisting of a polyvinylalcohol, a poly(meth)acrylic acid, a poly(meth)acrylamide, a polyhydroxyethyl(meth)acrylate, a polyvinylmethylether, a polysacharide.

10. A method according to claim 1 wherein said hydrophilic binder in said ink-repellant layer is a polyvinyl alcohol being cross-linked by means of a hydrolysed tetra-alkyl orthosilicate.

11. A method according to claim 1 wherein said image forming layer further comprises a diazonium salt, diazo resin or aryldiazosulfonate resin and said imaging element is overall exposed to UV-light subsequent to development.

* * * * *